United States Patent [19]

Craig

[11] Patent Number: 4,676,081

[45] Date of Patent: Jun. 30, 1987

[54] SNAP-IN SEMI-FLUSH MOUNTED PANEL LOCK

[75] Inventor: Clark Craig, Simpsonville, S.C.

[73] Assignee: Keycon Industries, Inc., Dallas, Tex.

[21] Appl. No.: 764,342

[22] Filed: Aug. 12, 1985

[51] Int. Cl.[4] ..... B65D 55/14; E05C 1/16

[52] U.S. Cl. ..... 70/169; 70/208; 70/DIG. 80; 292/153; 292/170; 292/337; 292/DIG. 31; 292/DIG. 38

[58] Field of Search ..... 70/166–169, 70/163, 467, 478, 488, 489, 158, 14, 145, 106, 208, DIG. 80; 292/170, DIG. 38, 137–140, 143, 153, DIG. 31, 337, 336.3

[56] References Cited

U.S. PATENT DOCUMENTS

| | | | |
|---|---|---|---|
| 655,543 | 8/1900 | Bohlen | 292/170 |
| 660,061 | 10/1900 | Macnamara | 70/DIG. 80 X |
| 1,021,864 | 4/1912 | Denzler | 70/488 X |
| 1,169,541 | 1/1916 | Hurd | 70/467 |
| 1,215,649 | 2/1917 | Gruber . | |
| 1,413,979 | 4/1922 | Freund . | |
| 1,434,373 | 11/1922 | Crompton et al. | 292/170 |
| 1,441,151 | 1/1923 | Hitchcock | 292/170 |
| 1,558,980 | 10/1925 | Halinka | 70/208 |
| 2,036,154 | 3/1936 | Littledale . | |
| 2,181,966 | 12/1939 | Dean | 411/508 X |
| 2,197,328 | 4/1940 | Wilson | 70/158 |
| 2,207,827 | 7/1940 | Schuyler et al. | 70/168 |
| 2,548,242 | 4/1951 | Rosenbarger | 70/145 |
| 2,780,485 | 2/1957 | Dedoes . | |
| 3,044,287 | 7/1962 | Pelcin | 70/488 X |
| 4,057,879 | 11/1977 | Eigenbrode | 292/87 X |
| 4,193,619 | 3/1980 | Jerila | 292/DIG. 38 X |
| 4,545,225 | 10/1985 | Mihojevich | 292/153 X |
| 4,580,818 | 4/1986 | Lyng | 292/DIG. 31 X |

FOREIGN PATENT DOCUMENTS

| | | | |
|---|---|---|---|
| 168261 | 3/1906 | Fed. Rep. of Germany | 292/170 |
| 2375413 | 8/1978 | France | 70/145 |
| 452815 | 8/1936 | United Kingdom | 70/111 |

*Primary Examiner*—Robert L. Wolfe
*Assistant Examiner*—Lloyd A. Gall
*Attorney, Agent, or Firm*—Allegretti, Newitt, Witcoff & McAndrews, Ltd.

[57] ABSTRACT

The panel lock comprises an elongated housing having resilient wedging means at each end to secure the panel lock in place in a recess in a door, panel or like member. Formed integrally with the elongated housing are a lock housing with a cylindrical opening, a central recessed portion, and a bolt housing. A lock is rotatably secured in the opening in the lock housing. A bolt is slidably positioned in the bolt housing. A spring is operative between the bolt and the bolt housing to bias the bolt outwardly from the bolt housing into locking position. An actuator is slidably secured to the elongated housing and is adapted to engage the bolt. When the actuator is moved in one direction, the bolt is biased outwardly to a latching position by the spring. Movement of the actuator in an opposite direction will move the bolt against the bias of the spring to a release position. Cam means are secured to the lock and are rotatable therewith to lock or to release the actuator.

The parts are essentially snap fitted together, there being a mechanical connection only between the cam means and the lock cylinder. The actuator is slidable longitudinally with respect to the elongated housing and the bolt is slidable transversely with respect to the actuator.

8 Claims, 9 Drawing Figures

SNAP-IN SEMI-FLUSH MOUNTED PANEL LOCK

BACKGROUND OF THE INVENTION

This invention relates to a panel lock adapted to be snapped into a recess in a movable member, such as a door or slide panel, and more particularly, to an improved panel lock that is adapted to be snapped into the door or panel it is intended to selectively lock in place and which has relatively few parts uniquely interrelated so as to provide an economical, yet reliable, panel lock.

The Dedoes U.S. Pat. No. 2,780,485 pertains to a combined latch and pull for doors and drawers that is reversible for either right or left latching. A V-shaped member is employed to move a bolt in opposition to the bias of a leaf spring. However, assembly of the parts is rather cumbersome and the combined pull and lock appears to be rather bulky.

An object of the present invention is to provide an improved panel lock that is reliable in use, has parts that essentially snap-fit together, is compact, and is relatively inexpensive.

Another object of the present invention is to provide a panel lock including an elongated housing comprising a cylindrical housing, a bolt arch and a recessed central portion; a lock rotatable in the cylindrical housing; a bolt slidable in the bolt arch, and being reversible for either right or left latching, a spring for biasing the bolt outwardly from the bolt arch; an actuator for moving the bolt in opposition to the bias of the spring; and a cam latch on the lock for engaging with and releasing the actuator, said parts being snap-fitted together and then retained by the securing of the cam latch to the lock cylinder. Other objects and advantages of the present invention will be made more apparent hereinafter.

BRIEF DESCRIPTION OF THE DRAWING

There is shown in the attached drawing a presently preferred embodiment of the present invention, wherein like numerals in the various views refer to like elements and wherein.

DETAILED DESCRIPTION OF THE PRESENT INVENTION

Figures 1, 2, 3, 4, 5, 6, 7, 8, 9:
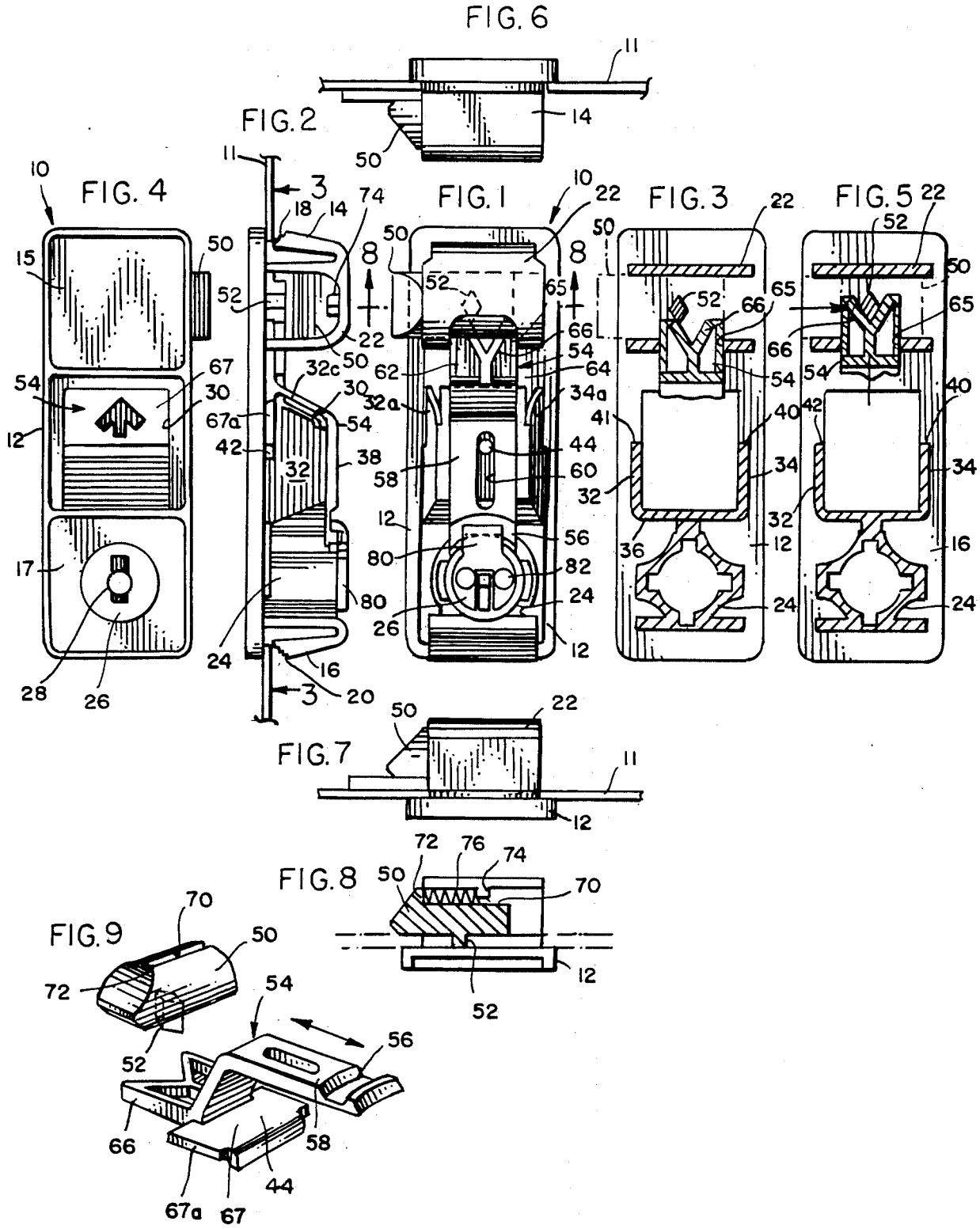
FIG. 1 is a rear view of the snap-in panel lock of the present invention.
FIG. 2 is a side view of the snap-in panel lock, illustrating the snap-in panel lock engaging a door or like member.
FIG. 3 is a cross-sectional view of the snap-in panel lock taken generally along the line 3—3 of FIG. 2, illustrating the bolt in the latching position.
FIG. 4 is a front view of the snap-in panel lock.
FIG. 5 is a cross-sectional view of the snap-in panel lock similar to FIG. 3 taken generally along the line 3—3 of FIG. 2, and illustrating the position of the components with the bolt in the unlatched position.
FIG. 6 is a top view of the snap-in panel lock, illustrating the snap-in panel lock engaging a door or like member.
FIG. 7 is a bottom view of the snap-in panel lock, illustrating the snap-in panel lock engaging a door or like member.
FIG. 8 is a cross section of the snap-in panel lock taken generally along the line 8—8 of FIG. 1.
FIG. 9 is an exploded perspective view of the bolt and bolt actuator.

The panel lock 10 illustrated in the drawing comprises an elongated substantially planar housing 12, which is generally rectangular as viewed in plan. The housing 12 is preferably molded from a suitable polymer, for example, a glass filled polyester or acetal. The panel lock 10 is adapted to be secured within a recess in a door or panel, by means of pressing the panel lock 10 into a recess within the door or panel 11, and having the resilient wedge members 14 and 16 at each end of the housing 12 engage the panel or drawer. The face of the panel lock would be substantially flush with the front surface of the door or panel 11 into which the panel lock is inserted. The material of the panel or drawer is wedged between the serrated ends 18 and 20 of the resilient wedging members 14 and 16, respectively and the rear of the panel lock housing flange, as best seen in FIG. 3.

As seen in FIG. 4, the front of the panel lock 10 includes substantially planar portions 15 and 17. The central portion of the panel lock housing 12 is recessed rearwardly, as will be more fully explaned hereinafter.

Extending rearwardly from the housing 12 is a bolt arch or bolt housing 22 and a housing 24 having a cylindrical opening for receiving a cylindrical lock 26. The cylindrical lock 26 is rotatable within the generally cylindrical housing 24. The cylindrical lock 26 is accessible from the face of the panel lock 10 as viewed in FIG. 4 so that a key may be inserted into the opening 28 of the cylindrical lock 26 to rotate the lock 26 within the housing 24.

Also extending from the rear of the housing 12 is a recessed central portion 30. The central portion 30 includes opposed sidewalls 32 and 34, a crosswall 36 and a rear wall 38. The rear wall 38 is connected to the opposed sidewalls 32 and 34. The forward ends of the sidewalls 32 and 34 are spaced from the rear face of the housing 12 so as to define slots 40 and 42 between the free portions **34*a* and 32*a* respectively of the sidewalls 34 and 32 and the rear of the housing 12. A guide projection 44 extends forwardly from the rear wall 38 of the recessed portion 30**.

Slidably retained within the bolt housing 22 is a bolt 50. The interior of the bolt housing 22 is complementary to the exterior of the bolt 50 and the bolt 50 is disposed in a loose sliding relationship within the opening or longitudinal passage of bolt housing 22. The bolt 50 is accessible from the opposed open ends of the bolt housing 22. Thus, a bolt 50 may be inserted for either left-hand or right-hand latching operation, as will be made more clear hereinafter. Depending from the bolt 50 is a projection 52.

Slidably secured to the housing 12 is an actuator 54. The actuator 54 includes a portion at one end having a recess 56 therein. The central portion 58 of the actuator 54 has an elongated slot 60 therein, which is extended longitudinally along the axis of the housing 12. The guide projection 44 from the central portion of the housing 12 extends into and is retained with the slot 60 during actuation of the actuator 54. The end 62 of the actuator 54 opposite from the recess 56 angles downwardly over the front opening 64 in the central portion of the housing 12. Provided on the end 62 of actuator 54 is V-shaped cam member 66, which is adapted to extend through an opening 65 in the side of the bolt housing 22 and engage with and actuate the projection 52 on the bolt 50. The actuating latch 67 of the actuator 54 is accessible from the front of the panel lock 10 (FIG. 4) to reciprocably move the actuator 54 in the direction of the arrows shown in FIG. 4 and in an opposite direction. The actuating latch 67 includes side edges 67*a* that are retained in slots or aligned openings 40 and 42 between the flexible portions 32*a*, 34*a* and the panel lock housing 12.

As best seen in FIGS. 8 and 9 there is a groove 70 provided in the bolt 50. The groove 70 is open at one end and has a wall 72 at the other end. Depending from the bolt housing 22 is a projection 74 which functions as a stop. A spring 76 is disposed in the groove 70 between the wall 72 of the groove 70 and the stop member 74. Thus, it will be observed that the spring 76 biases the bolt 50 outwardly from the bolt housing 22.

As shown in FIGS. 1, 3, and 4 the spring 76 biases the bolt 50 outwardly from the bolt housing 22. The bolt 50 may engage in a latch in the frame so as to retain the door or panel 11 in a locked position. At the same time actuator 54 is moved to the position shown by the interengagement of projection 52 with cam member 66. When the actuator 54 is moved by the operator upwardly, as illustrated in FIG. 5, the V-shaped cam member 66 engages with the projection 52 on the bolt 50 and urges the bolt 50 inwardly out of its latched position. When the actuator 54 is released, it will be returned to the position shown in FIG. 3, for example. Spring 76 not only biases the bolt 50 outwardly, but as a result of the cooperative association between projection 52 on the bolt 50 and the V-shaped cam member 66 on actuator 54, biases the actuator 54 to the position shown in FIG. 3.

A feature of the present invention is the unique interengagement and assembly of the parts. The actuator 54 is molded as one piece as best seen in FIG. 9. The housing 12 is molded as one piece integrally with the bolt housing 22, the central portion 30 and the housing 24 for lock 26. These parts may be molded from a suitable plastic polymer, as for example a glass filled polyester or acetal. The bolt 50 is preferably fabricated from a metal, such as brass. The lock 26 may be made from a suitable metal, as for example brass.

To assemble the panel lock 10, the actuator 54 is positioned on the rear of the housing 12 with the V-shaped cam member 66 extending through the opening in bolt housing 22 into engagement with the projection 52. The actuating latch 67 of the actuator 54 is pressed downwardly so as to flex the wall portion 34*a* and 32*a* outwardly. The actuating latch 67 is pressed into the slots 40 and 42, and the flexible portions 32*a* and 34*a* snap back because of their resiliency over the rear face of the planar end portion 62 and entrap the actuating latch 67. Alternatively, the parts may be configured so that the side edges 67*a* of the actuating latch 67 may be slid into slots 40, 42 without flexing the portions 32*a*, 34*a* of the walls 32 and 34. The projection 44 extending from the rear of the central portion of actuator 54 is engaged within the slot 60. The spring 76 is positioned in the groove 70 of bolt 50 and the bolt 50 is slid into the bolt housing 22. The lock or lock plug 26 is positioned in the housing 24. The cam latch 80 secured to the rear of the lock 26, for example, by staking the ends of pins as indicated at 82, is then rotatable into and out of engagement with the recess 56. When the cam latch 80 is in engagement with the recess 56, then the actuator 54 is locked in position. The spring 76 at this time is able to urge the bolt 50 to its locked position. The V-shaped cam member 66 of actuator 54 retains bolt 50 in the bolt house 22 once the lock plug 26 is in place in its housing 24.

In order to release the cam latch 80 from the recess 56, a key is inserted into the lock 26 and the cam latch 80 is rotated out of the engagement with the recess 56 on actuator 54. The operator may insert a finger into the recessed opening in the recessed portion of the housing 12 into engagement with latch 67 and move the actuator 54. As indicated in FIG. 5, for example, the cam member 66 on the actuator 54 will engage with the projection 52 on the bolt 50 to the right to release the bolt 50 from its locking position and permit opening of the panel 11 with which the lock 10 is associated. Spring 76 is compressed as the bolt 50 is moved inwardly. When the actuator 54 is released, the spring 76 will expand and bias the bolt 50 outwardly and the actuator 54 to its normal position shown e.g. in FIG. 1.

There has been provided by the present invention a unique panel lock 10 that is able to be snapped into place in a recess of a door or panel in an expeditious fashion. The face of the panel lock 10 is substantially flush with the face of the door or panel. The resilient wedging members 14 and 16 will yield as the panel lock 10 is pressed into the recess and when the metal of the door or panel is moved past the teeth 20 and 18, the teeth 20 and 18 will engage the rear of the door or panel 11, to retain the panel lock 10 in a position. The panel lock 10 itself is fabricated of few parts which interengage in a snap-fit relationship, but for the cam latch which is staked to the rotatable cylindrical lock 26. The panel lock of the present invention is reliable in use and because of relatively few components and ease of assembly is manufactured relatively inexpensively.

While I have shown a presently preferred embodiment of the invention, it will be apparent to those skilled in the art that the invention may be otherwise embodied in the scope of the amended claims.

What is claimed is:

1. A panel lock adapted to be secured in a recess in a panel, comprising an elongated panel lock housing, securing means on the panel lock housing for securing the panel lock housing to a panel, said securing means comprising resilient wedging means at each end of the elongated panel lock housing, said panel lock housing having a housing with a cylindrical opening extending from the back thereof, a cylindrical lock adapted to be secured in said cylindrical opening, a bolt housing secured to and extending from the back of said panel lock housing, said bolt housing being open at each end and having a longitudinal passage therethrough, a bolt adapted to be slidably received within said bolt housing, spring means for biasing the bolt outwardly from said bolt housing, a projection extending from said bolt, an actuator slidably carried on said panel lock housing and cooperating with said projection on said bolt for moving the bolt in opposition to the outward bias of said spring means, and a cam latch secured to said cylindrical lock and movable therewith to engage with and retain the actuator, whereby when the actuator is released from the cam latch, the actuator may be slid in a first direction to move the bolt inwardly with respect to the bolt housing and when the bolt is biased outwardly from the bolt housing by the spring means, the actuator is moved in an opposite direction from said first direction, a central portion of the panel lock housing being recessed, and a portion of the actuator being accessible from the front of said recessed central portion for manual manipulation by an operator, said recessed central portion including opposed walls secured to the panel lock housing and a wall connecting the opposed walls, a guide projection extending rearwardly from the wall connecting the opposed walls, said actuator including a portion slidable on said wall connecting the opposed walls, said portion having an elongated slot therein, said guide projection being disposed within said elongated slot, said opposed walls each including portions free from the panel lock housing and spaced to provide slots, said actuator having a portion with side edges received in said slots, said side edges being slidably retained in said slots.

2. A panel lock as in claim 1 wherein the actuator includes a cam that cooperates with the projection from the bolt.

3. A panel lock as in claim 2 wherein the cam has a V-shaped actuating surface engaging with the projection from the bolt.

4. A panel lock as in claim 1 wherein the actuator includes a portion having an elongated slot therein and said recessed central portion of the panel lock housing has a guide projection extending rearwardly therefrom, said guide projection being positioned within said slot.

5. A panel lock as in claim 1 wherein the cylindrical lock is rotatable within said opening and said cam latch is rotatable with said cylindrical lock.

6. A panel lock as in claim 5 wherein the actuator has a recess in the end thereof proximate the cam latch, said cam latch being rotatable into engagement with said recess to retain said actuator and being rotatable out of engagement with said recess to release said actuator.

7. A panel lock as in claim 1 wherein said bolt is provided with a groove in the outer surface thereof, said spring means comprising a spring positioned in said groove, and a stop on the bolt housing, said spring being disposed between an end wall of the groove and said stop on the bolt housing.

8. A panel lock adapted to be secured in a recess in a panel, comprising an elongated panel lock housing, securing means on the panel lock housing for securing the panel lock housing to a panel, said securing means comprising resilient wedging means at each end of the elongated panel lock housing, said panel lock housing having a housing with a cylindrical opening extending from the back thereof, a cylindrical lock adapted to be secured in said cylindrical opening, a bolt housing secured to and extending from the back of said panel lock housing, said bolt housing being open at each end and having a longitudinal passage therethrough, a bolt adapted to be slidably received within said bolt housing, spring means for biasing the bolt outwardly from said bolt housing, a projection extending from said bolt, an actuator slidably carried on said panel lock housing and cooperating with said projection on said bolt for moving the bolt in opposition to the outward bias of said spring means, and a cam latch secured to said cylindrical lock and movable therewith to engage with and retain the actuator, whereby when the actuator is released from the cam latch, the actuator may be slid in a first direction to move the bolt inwardly with respect to the bolt housing and when the bolt is biased outwardly from the bolt housing by the spring means, the actuator is moved in an opposite direction from said first direction, a central portion of the panel lock housing being recessed, and a portion of the actuator being accessible from the front of said recessed central portion for manual manipulation by an operator, said recessed central portion including opposed walls secured to the panel lock housing and a wall connecting the opposed walls, a guide projection extending rearwardly from the wall connecting the opposed walls, said actuator including a portion slidable on said wall connecting the opposed walls, said portion having an elongated slot therein, said guide projection being disposed within said elongated slot, said opposed walls each including flexible portions free from the panel lock housing, said flexible portions being spreadable to enable a planar portion of the actuator to be pushed past the flexible portions into aligned openings between the flexible portions and the panel lock housing, said aligned openings retaining the actuator in sliding relationship with the panel lock housing.

* * * * *